US006179440B1

(12) United States Patent
Palmer

(10) Patent No.: US 6,179,440 B1
(45) Date of Patent: Jan. 30, 2001

(54) ROPE LIGHT

(75) Inventor: Terrance L. Palmer, Glenview, IL (US)

(73) Assignee: Aura Lamp & Lighting, Inc., IL (US)

( * ) Notice: Under 35 U.S.C. 154(b), the term of this patent shall be extended for 0 days.

(21) Appl. No.: 09/261,820

(22) Filed: Mar. 3, 1999

(51) Int. Cl.[7] ..... F21S 4/00; F21V 21/00
(52) U.S. Cl. ..... 362/249; 362/382
(58) Field of Search ..... 362/249, 250, 362/252, 278, 320, 806, 382

(56) References Cited

U.S. PATENT DOCUMENTS

| | | | | |
|---|---|---|---|---|
| 4,128,863 | * | 12/1978 | Premetz | 362/249 |
| 4,244,014 | * | 1/1981 | Van Ess | 362/249 |
| 4,516,193 | | 5/1985 | Murphy | 362/123 |
| 4,597,033 | * | 6/1986 | Meggs et al. | 362/278 |
| 5,410,458 | * | 4/1995 | Bell | 362/249 |
| 5,544,028 | * | 8/1996 | Carlin | 362/249 |
| 5,934,792 | | 8/1999 | Camarota . | |
| 6,030,096 | * | 2/2000 | Lin | 362/249 |

OTHER PUBLICATIONS

"Special Effects—The Basics", web page print out, dated Sep. 9, 1998.

Advertisement—Sof–Touch™ Flexible Lighting System, Aura Lamp and Lighting, Inc., No date.

Advertisement—Sof–Touch™ Flexible Lighting System, ITC Incorporated, No date.

* cited by examiner

*Primary Examiner*—Alan Cariaso
*Assistant Examiner*—Belur Keshavan
(74) *Attorney, Agent, or Firm*—Bullwinkel Partners, Ltd.

(57) ABSTRACT

A rope light includes a flexible lighting strip, multiple trapezoidal shaped flanges attached to the flexible lighting strip, and gaps evenly spaced between the flanges. The rope light may be attached to a wall or other surface by placing hooks or staples through the flanges or by placing hooks through slots in the flanges. The rope light may also be attached to a wall, or other surface, by using an attachment strip.

5 Claims, 3 Drawing Sheets

22
30
28
26
12
18
24
16
14
24
14

22
28
24
26
18
14

28
24
14
12
22

28
24
12
22
14

26
28
24
22
14
18
6
6

ROPE LIGHT

BACKGROUND OF THE INVENTION

1. Field of the Invention

This invention relates to flexible lighting strips, and more particularly to flexible lighting strips used to illuminate kitchen cabinets, decks, stairs or walkways.

2. Description of the Related Art

Flexible lighting strips, or rope lights, are known in the art for illuminating structures both indoors and outdoors. For example, ITC, Inc. in Holland, Michigan sells a flexible lighting strip under the trademark Sof-Touch to the Marine Industry. The ITC Sof-Touch product comprises a flexible lighting strip with a continuous flange running the length of the strip.

Generally, rope lights are installed by applying staples though the flange and thereby attaching the rope light to the desired surface. In some instances, installing a rope light in the desired location requires bending the rope light. However, conventional rope lights with continuous flanges are difficult for the consumer to bend and install.

Therefore, a need exists for a rope light which is easy to bend and install in the desired location. The present invention is designed to fill this need.

SUMMARY OF THE INVENTION

The present invention is a rope light having multiple flanges disposed along the length of the flexible lighting strip and gaps between the flanges. Preferably, the flanges comprise flexible trapezoidal pieces, although other suitable shapes are contemplated. The gaps between the flanges allow easier bending of the flexible lighting strip while the multiple flanges still provide a means for attaching the flexible lighting strip to the desired location.

Also disclosed is an attachment strip which can be used as an alternative means to attach the rope light to a wall or other surface. The attachment strip can also be used to attach other decorative lighting fixtures to walls or other surfaces or to attach a variety of other items to other objects, such as vines to a trellis.

Thus, it is a principal object of this invention to provide a rope light that is easy to bend and install.

Another object of the invention is to provide a flexible lighting system.

Another object of the invention is to provide a rope light with multiple flanges and gaps between the flanges.

DETAILED DESCRIPTION OF THE DRAWINGS

Figures 1, 2:
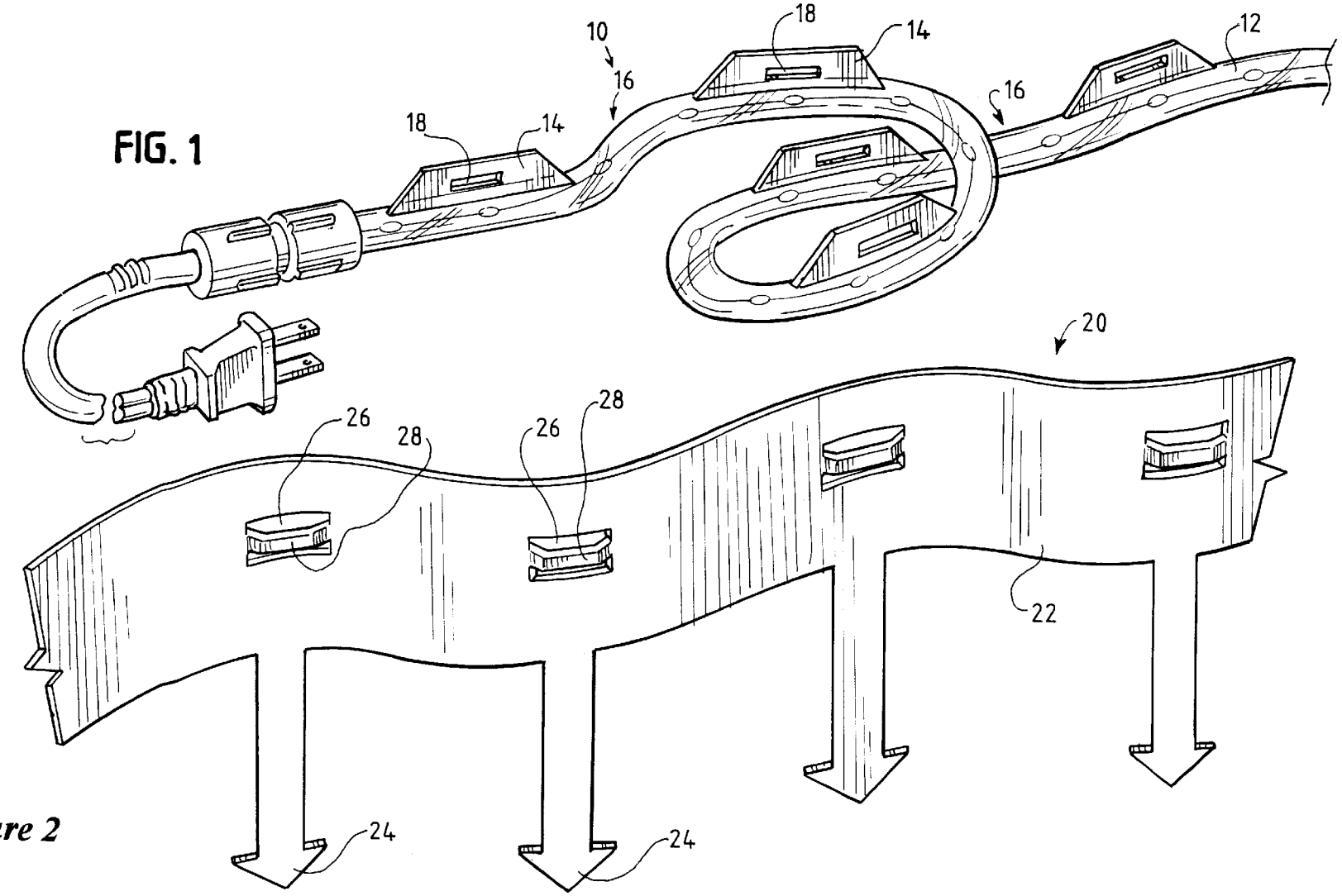
FIG. 1 is a side view of a rope light according to the present invention.
FIG. 2 is a side view of an attachment strip according to the present invention.

Turning to the drawings, there is shown in FIG. 1 a rope light 10 according to the present invention. The rope light 10 comprises a substantially cylindrical flexible lighting strip 12, flanges 14 extending radially from the flexible lighting strip and gaps 16 spaced between the flanges 14. Preferably, the gaps 16 are spaced evenly between the flanges 14. As is known in the art, the flexible lighting strip 12 can be made of flexible plastic or other suitable material. The flexible lighting strip 12 can be any required length and can be cut to any desired length. Preferably, the flanges 14 are trapezoidal in shape with the length being 2.5 inches (6.35 cm) along the line of attachment to the flexible lighting strip 12 and 1.75 inches (4.45 cm) in length along the outer edge of the flange and ⅝ inch (1.59 cm) in width. The width of the gap 16 can be any desired width depending on the desired flexibility of the rope light. The flange 14 may have a slot 18 or other opening for accommodating a means of attachment.

Within the flexible lighting strip 12 are miniature light bulbs running along its length. The flexible lighting strip 12 can be connected to a standard electrical cord for plugging into a standard outlet.

The rope light 10 can be attached to a wall or other desired surface by placing staples or tacks (not shown) through the flanges 14. Alternatively, hooks, or other hanging means, may be placed through the slots 18 in order to attach the rope light 10 to a wall or other desired surface. The multiple flanges 14 spaced evenly along the flexible lighting strip 12 provide the advantage that the rope light of the present invention is easier than conventional rope lights, having a single continuous flange, to bend and install.

Alternatively, the rope light 10 may be attached to a wall or other surface using an attachment strip 20. As is shown in FIG. 2, the attachment strip 20 comprises an elongated flexible plastic strip 22, elongated bands 24, slots 26 disposed lengthwise in the elongated flexible plastic strip 22, and loops 28 extending over the slots 26. The flexible plastic strip 22 can be any required length and can be cut to any desired length.

The flexible plastic strip 22 can be made of plastic or other suitable flexible material and can be any suitable width. In the preferred embodiment, the elongated bands 24 extend from the flexible plastic strip 22 and terminate with an arrow shape, although any shape that will hold the elongated bands through the slots 26 is contemplated. The arrow shaped end of the elongated band 24 feeds through the slot 26 and under the loop 28, similar to how a belt feeds through a belt loop. The length of the elongated band 24 can be any suitable length, but preferably is long enough to extend through the slots 18 of the rope light 10 and under the loop 28, as described below.

Figure 3:
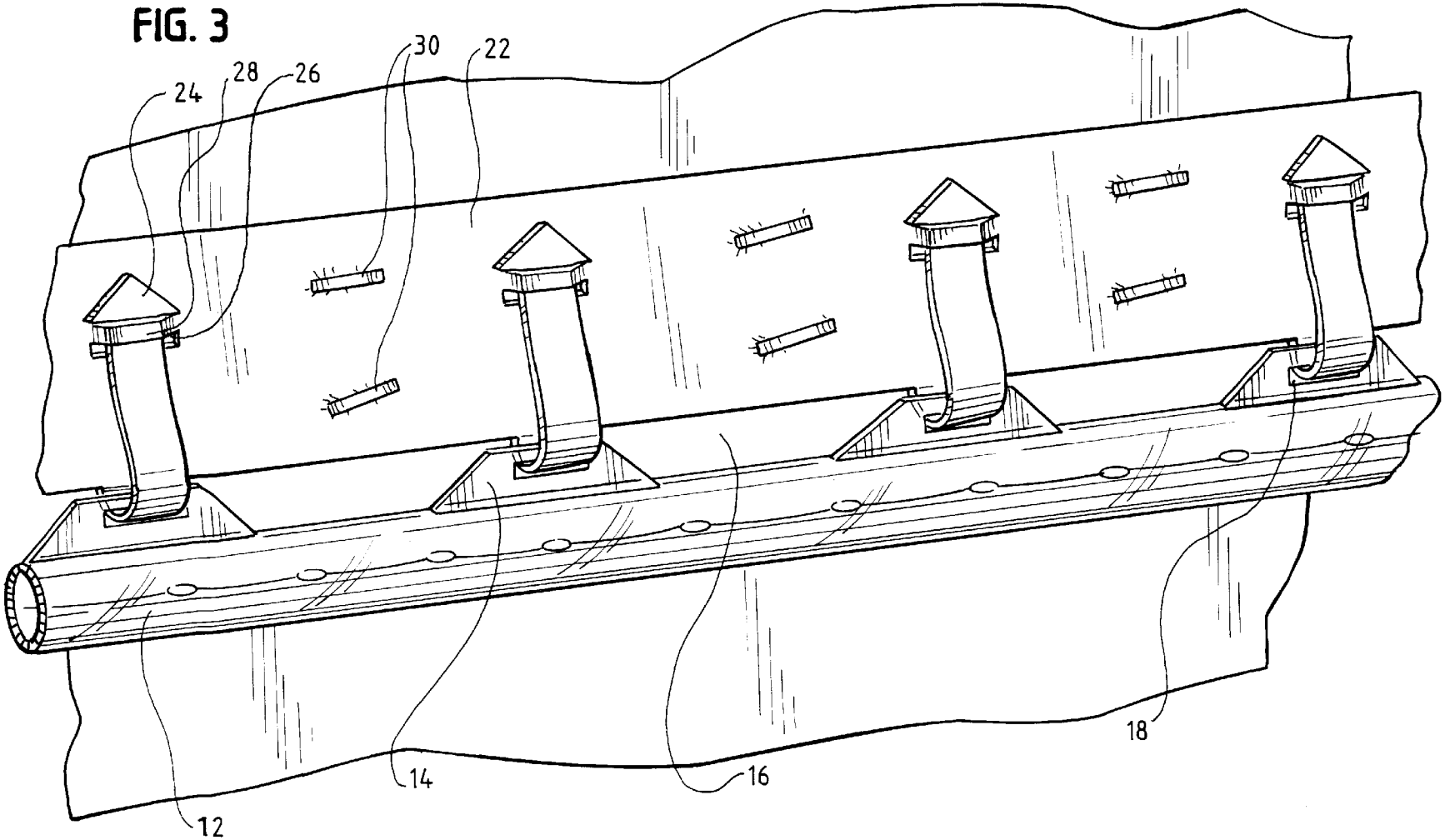
FIG. 3 is a side view of the rope light of FIG. 1 connected to the attachment strip of FIG. 2
Figures 4, 5, 6, 7, 8:
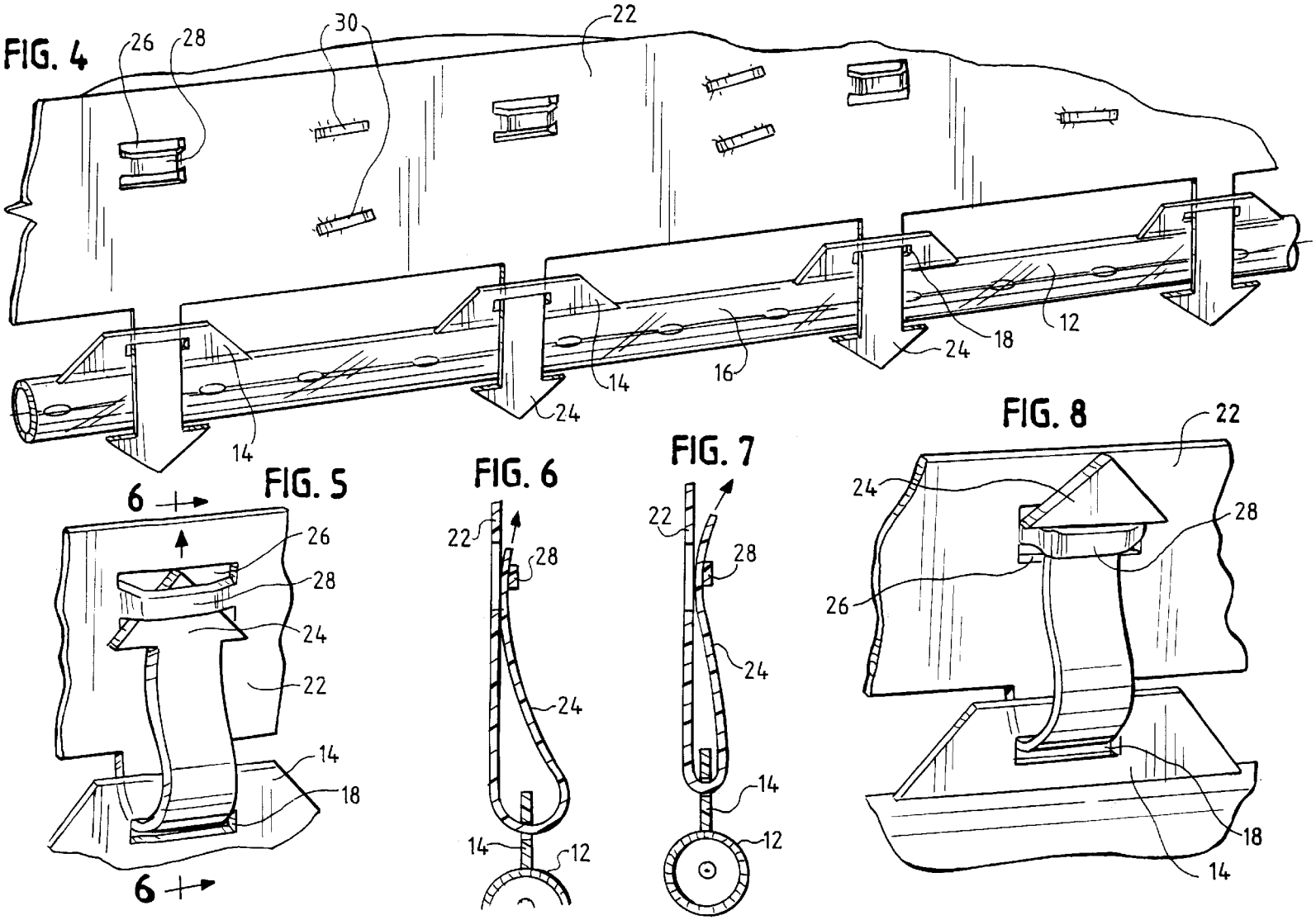
FIG. 4 is a side view of the rope light of FIG. 1 and the attachment strip of FIG. 2 showing the first step in connecting the rope light to the attachment strip.
FIG. 5 is a side view of one section of the rope light and attachment strip showing the elongated band feeding through the slot and under the loop of the attachment strip.
FIG. 6 is a cross-section of FIG. 5 taken along line 6—6.
FIG. 7 is a cross-section of FIG. 5 taken along line 6—6, showing the elongated band feeding further through the slot and under the loop of the attachment strip.
FIG. 8 is a side view of one section of the rope light connected to the attachment strip.

As shown in FIGS. 3–4, the attachment strip 20 can be attached to a wall or other surface by staples 30 or other suitable attachment means. To attach the rope light 10 to the attachment strip 20, as shown in FIG. 4, the arrow shaped ends of the elongated bands 24 are first fed through the slots 18 in the flanges 14 of the rope light 10. Then, as shown in FIGS. 5–8, the elongated bands 24 are looped in an upward direction and the arrow shaped ends feed through the slots 26 of the attachment strip 20 under the loops 28. The arrow shaped ends of the elongated bands 24 secure the connection in the slot 26 under the loop 28 and, by resting on the loop 28, prevent the elongated band 24 from coming back through the slot 26.

By mounting the attachment strip 20 on a wall or other surface, different rope lights can be easily attached to, and detached from, the attachment strip, depending on the season, without the inconvenience of re-stapling the rope light to the wall each time.

Other modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. A flexible lighting system comprising:

a. a substantially cylindrical flexible lighting strip containing miniature light bulbs running along the inside length of the lighting strip; and b. a plurality of flanges extending radially from the flexible lighting strip, said flanges being spaced apart to allow the flexible lighting strip to be bent and installed onto a surface, each of said flanges having a slot disposed therein for accommodating a means of attachment.

2. The flexible lighting system of claim 1 wherein the flanges are substantially trapezoidal in shape.

3. The flexible lighting system of claim 1 further comprising an end cap attached to an end of the flexible lighting strip for connecting the flexible lighting strip to a standard electrical cord that can be plugged into a standard electrical outlet.

4. A rope light comprising:

a. a flexible lighting strip;

b. at least two flanges attached to the flexible lighting strip; and c. a gap spaced between the flanges;

wherein the flexible lighting strip is attached to a surface by means of an attachment strip, the attachment strip comprising a flexible plastic strip, at least two elongated bands extending from the plastic strip, at least two slots in the flexible plastic strip to receive the elongated bands, and a loop extending over each slot.

5. A flexible lighting system comprising:

a. a substantially cylindrical flexible lighting strip containing miniature light bulbs running along the inside length of the flexible lighting strip;

b. a plurality of flanges extending radially from the flexible lighting strip, said flanges being spaced apart to allow the flexible lighting strip to be bent and installed onto a surface, said flanges having openings therein; and c. an attachment strip for attaching the flexible lighting strip to a surface, the attachment strip comprising an elongated flexible strip having slots disposed lengthwise therein and loops extending over the slots, the attachment strip further comprising bands extending from the elongated flexible strip;

wherein the bands are configured to extend through the flange openings and then feed through the slots in the elongated flexible strip to secure the flexible lighting strip to the attachment strip;

and wherein the attachment strip may be attached to said surface by attachment means.

* * * * *